US006364621B1

(12) United States Patent
Yamauchi

(10) Patent No.: US 6,364,621 B1
(45) Date of Patent: Apr. 2, 2002

(54) METHOD OF AND APPARATUS FOR CONTROLLING VACUUM PUMP

(75) Inventor: Kazuhiko Yamauchi, Kusatsu (JP)

(73) Assignee: Almotechnos Co., Ltd., Shiga (JP)

( * ) Notice: Subject to any disclaimer, the term of this patent is extended or adjusted under 35 U.S.C. 154(b) by 0 days.

(21) Appl. No.: 09/562,326

(22) Filed: May 1, 2000

(30) Foreign Application Priority Data

Apr. 30, 1999 (JP) ..... 11-124953

(51) Int. Cl.[7] ..... F04B 49/06
(52) U.S. Cl. ..... 417/44.11; 417/12
(58) Field of Search ..... 417/2, 12, 44.1, 417/45, 44.11

(56) References Cited

U.S. PATENT DOCUMENTS 5,076,761 A * 12/1991 Krohn et al. ..... 417/18
5,447,414 A * 9/1995 Nordby et al. ..... 417/20
5,971,711 A * 10/1999 Joji et al. ..... 417/901
6,109,879 A * 8/2000 Yamada et al. ..... 417/38

FOREIGN PATENT DOCUMENTS

JP 2000-110735 4/2000

* cited by examiner

*Primary Examiner*—Charles G. Freay
(74) *Attorney, Agent, or Firm*—Armstrong, Westerman & Hattori, LLP

(57) ABSTRACT

There is disclosed a controlling apparatus for controlling at least one vacuum pump and comprising: at least one vacuum pump having a pump body for sucking a gaseous body from a clean room and exhausting the clean room or the gaseous body and a driving motor for driving the pump body; and a controlling section for controlling the driving motor. The controlling apparatus includes a power measurement device, which measures a driving power to be sent to the driving motor. If the power measurement device measures power which reaches or exceeds a warning value, above a fixed value, then the controlling section switches the state of the at least one vacuum pump from a steady operational state into an unusual event checking state, during which an inspection of the vacuum pump is carried out.

18 Claims, 9 Drawing Sheets

METHOD OF AND APPARATUS FOR CONTROLLING VACUUM PUMP

BACKGROUND OF THE INVENTION

1. Field of the Invention

The present invention relates to a method of and apparatus for controlling vacuum pump for use in forming a vacuum in a clean room, etc.

2. Description of the Related Art

A plurality of vacuum pumps are arranged for retaining a vacuum inside a clean room, wherein at least one semiconductor production line is, etc. is prepared. One vacuum pump comprises a pump body for sucking a gaseous body from the clean room, and a driving motor for driving the pump body. After the driving motor rotates, the pump body is activated. Then, the pump body exhaust the clean room of any gaseous body, for example, air and the like.

In the conventional vacuum pumps, the driving motor included in each vacuum pump is directly connected to a commercial power source, for example, a three-phase 200 V power source, and is rotationally driven by a current sent from the commercial power source at a predetermined rotational frequency. According to this conventional structure, too much power has, in many cases, been consumed, thus can not be accomplished to meet the recent demand for saving electric power.

In order to comply with such a demand, it is suggested that the vacuum pumps are controlled as follows: In particular, an inverter is prepared so as to control the rotational frequency of the driving motor included in each vacuum pump. A vacuum degree detecting section is prepared in order to detect the degree of vacuum inside the clean room. In this structure, the frequency of a driving current, which is sent to the driving motor, can be controlled by the inverter with reference to a detection signal output by the vacuum degree detecting section.

In addition to the above-described method, it is also suggested that the inverter for controlling the rotational frequency of the driving motor included in each vacuum pump and a rotational frequency detecting section for detecting the rotational frequency of the driving motor are combined together. In this structure, controlling of the frequency of the driving current, which is sent to the driving motor, may be achieved by the inverter with reference to a detection signal output from the rotational frequency detecting section.

However, even if the driving motor included in each vacuum pump is controlled in the above-described manner, the above-described conventional methods are for maintaining a predetermined degree of vacuum inside the clean room. Therefore, monitoring and determining of whether the vacuum pumps have nearly worn out or not is not performed. Thus, when the vacuum pumps have worn out as a result of a long-term use, the degree of vacuum inside the clean room can not preferably be retained. This result in producing defective semiconductors which are to be produced inside the clean room, causing a great loss of money. In consideration of the above facts, it has been desired that a controlling apparatus, which can retain the degree of vacuum inside the clean room while monitoring whether the vacuum pumps have nearly worn out, is realized.

SUMMARY OF THE INVENTION

An object of the present invention is to provide a controlling apparatus for and method of controlling vacuum pump, for achieving protection of vacuum pump, maintaining a degree of vacuum inside a room (e.g., a clean room), and monitoring of whether a driving motor included in each vacuum pump has nearly worn out.

According to the present invention, there is provided a controlling apparatus, for controlling at least one vacuum pump, comprising: at least one vacuum pump which includes a pump body for sucking a gaseous body from a room and exhausting the room of the gaseous body and a driving motor for driving the pump body; and controlling means for controlling the driving motor included in the at least one vacuum pump, and the controlling apparatus including a power measurement device which measures driving power to be sent to the driving motor, and wherein the controlling means switches a state of the at least one vacuum pump from a steady operational state into an unusual event checking state, in which any unusual event in the at least one vacuum pump is detected, when a value of the power measured by the power measurement device is equal to or exceeds a warning value which is higher than a fixed value.

According to the present invention, there is provided a method of controlling at least one vacuum pump, which comprises a pump body for sucking a gaseous body from a room and exhausting the room of the gaseous body and a driving motor for driving the pump body, the method comprising switching a state of the at least one vacuum pump from a steady operational state into an unusual event checking state, in which any unusual event in the at least one vacuum pump is detected, when a value of driving power to be sent to the driving motor is equal to or exceeds a warning value, which is higher than a fixed value.

BRIEF DESCRIPTION OF THE DRAWINGS

Other objects and advantages of the present invention will become fully apparent upon reading of the following detailed description and the accompanying drawings in which.

DETAILED DESCRIPTION OF THE PREFERRED EMBODIMENTS

Explanations will now be made to embodiments of a method of and a controlling apparatus of controlling a vacuum pump according to the present invention, with reference to the accompanying drawings.

Figure 1:
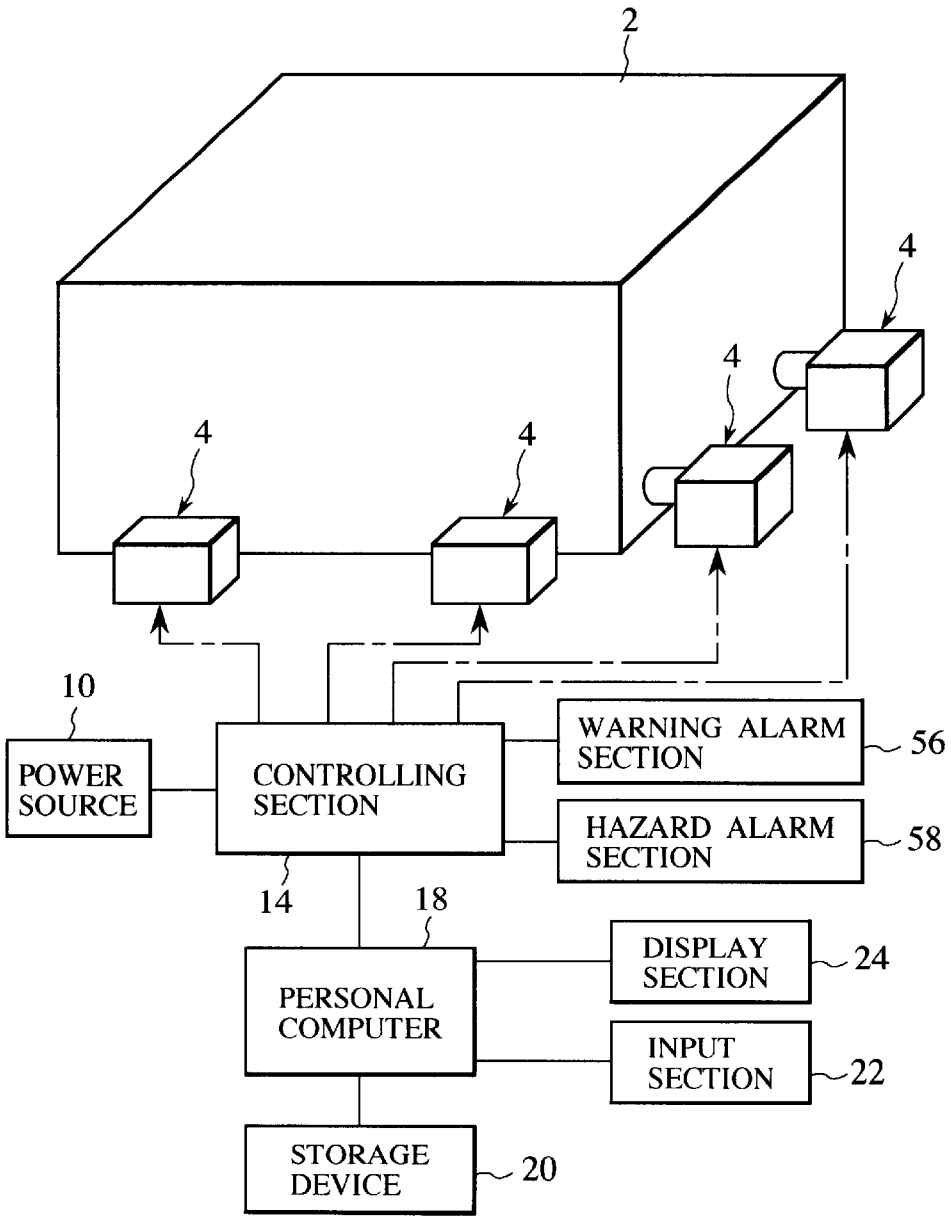
FIG. 1 is a schematic diagram schematically showing a clean room which adopts a controlling apparatus (a controlling apparatus which carries out a process of controlling a vacuum pump according to the present invention) controlling a vacuum pump according to the present invention.
Figure 2:
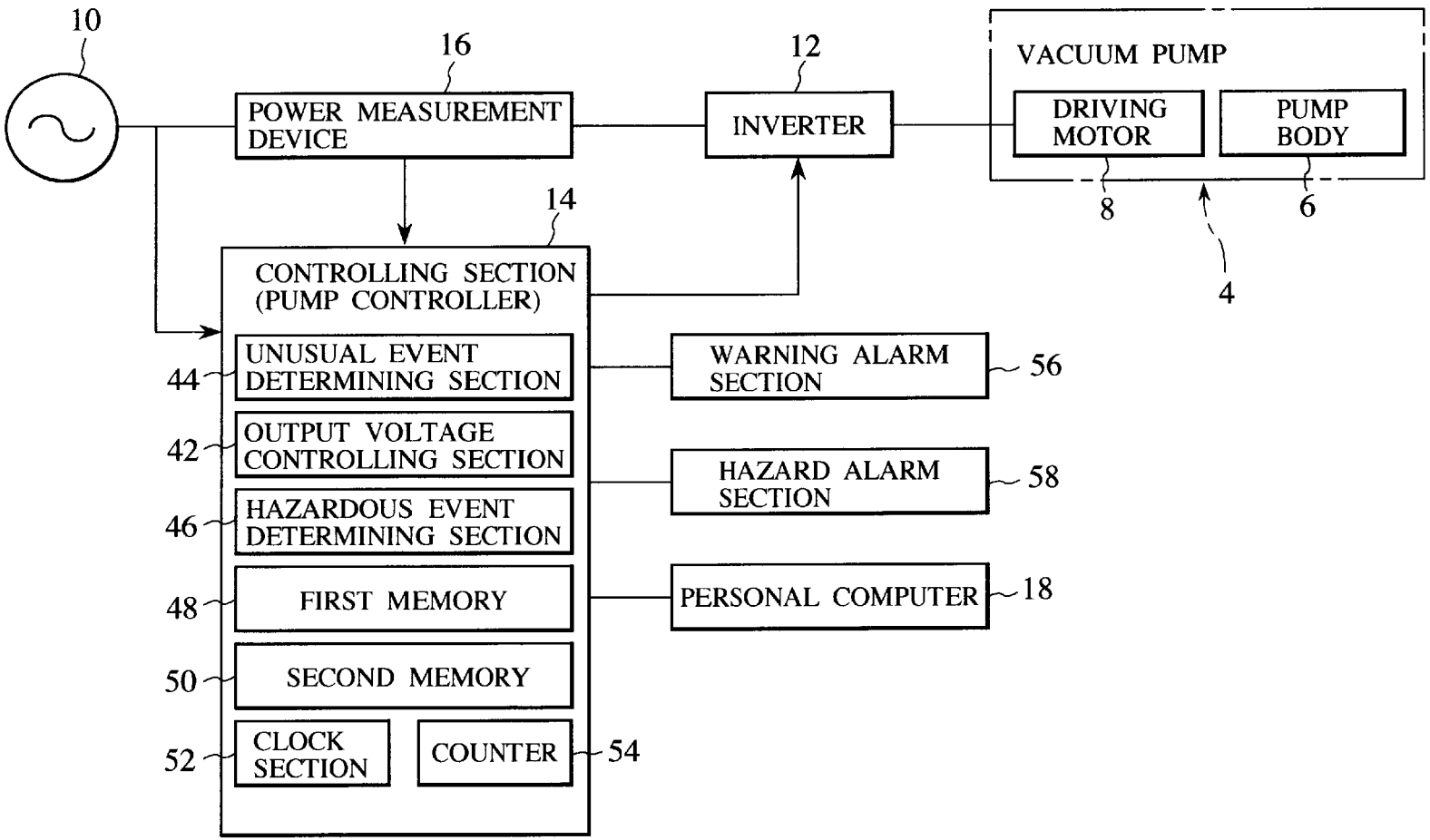
FIG. 2 is a block diagram schematically showing the controlling apparatus controlling the vacuum pump shown in FIG. 1.

The controlling apparatus according to the first embodiment of the present invention will now be described by referring to FIGS. 1 to 8. In FIG. 1, a nearly-rectangular-parallelepiped room 2 is a clean room, for example, which is formed inside a building, and to which a plural number (in FIG. 1, four) of vacuum pumps 4 are connected. With reference also to FIG. 2, the plural number of vacuum pumps 4 have substantially the same structure as one another, and each comprises a pump body 6 and a driving motor 8 which is connected to the pump body 6 so as to drive the pump body 6. When the driving motor 8 is rotationally driven, the pump 6 is also activated, and sucks the gaseous body from the clean room 2 and exhaust the clean room 2 of, for example, air. This maintains the vacuum inside the clean room 2 in a clean state. Inside of this clean room, a semiconductor manufacturing line and a semiconductor wafer process line, etc. are prepared.

The driving motor 8 included in each of the vacuum pumps 4 comprises, for example, a three-phase AC motor, to which a driving current from a power source 10, which serves as a power three-phase 200V power source (whose frequency is 50 Hz or 60 Hz), is supplied. In this embodiment, the current from the power source 10 is sent to an inverter 12 which converts the frequency of the sent current as described later, thereafter the current is sent to the driving motor 8. By doing this, i.e., by converting the frequency of the driving current to be sent to the driving motor 8, the rotational frequency of the driving motor 8 is controlled. After the driving current from the power source 10 is converted into a direct voltage, thus converted current is sent to a controlling section 14 which serves as a pump controller. This controlling section 14 comprises, for example, a micro-processor, etc., and controls the vacuum pumps 4 in a manner explained later. This controlling section 14 may be prepared for each vacuum pump 4, so that each vacuum pump 4 may individually be controlled.

In this embodiment, there is arranged a power measurement device 16 (refer to FIG. 2), which measures the driving power to be sent to each of the vacuum pumps 4, i.e., the power to be consumed thereby, and which outputs a signal representing the measured power to the controlling section 14. The controlling section 14 monitors whether there is any unusual event in the vacuum pumps 4 based on the signal, and changes the operational state of the vacuum pumps 4. Data regarding the operational state of the vacuum pumps 4 are sent to the controlling section 14, and further sent to a personal computer 18, and stored in a storage device 20, such as an HDD, etc., which is attached to the personal computer 18.

The personal computer 18 is connected to an input section 22 and a display section 24. The input section 22 includes a keyboard, a mouse, etc. The display section 24 may be a CRT or a liquid crystal display device. Various data representing the operational state of the vacuum pumps 4 can be selected by manipulation of the input section 22. Thus selected data is displayed on the display section 24, thereby informing an operation, who views the data, of the operational state of each of the vacuum pumps 4.

Figure 3:
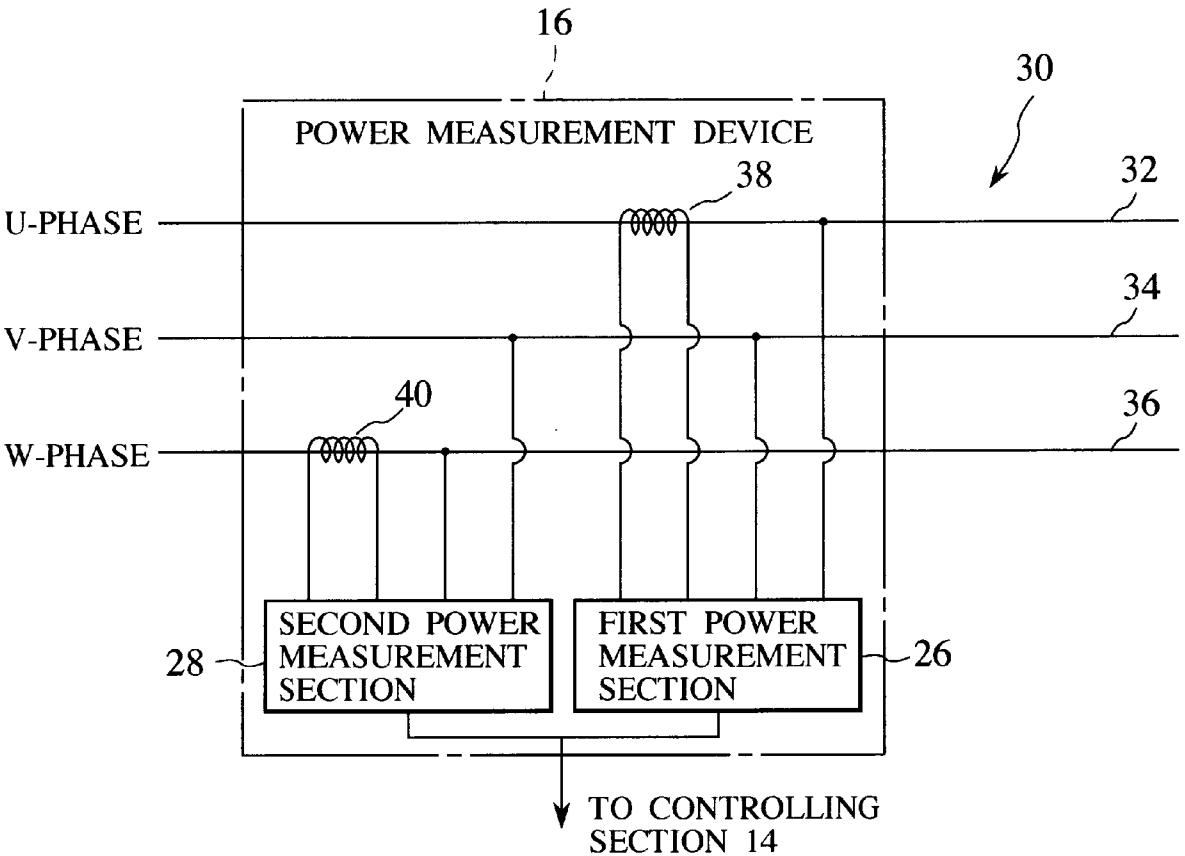
FIG. 3 is a schematic diagram showing a power measurement device which the controlling apparatus shown in FIG. 2 comprises.

The power measurement device 16 will now be explained with reference to FIG. 3. The consumption power of three-phase-alternating current power can be detected according to the following steps. First, products of values of currents which respectively flow through arbitrary two lines among three lines (U-phase, V-phase and W-phase) and values of voltages to be respectively applied to the two lines are obtained, so that values of electric power of the two lines can be obtained as well. Then, those obtained values of electric power of the two lines are added together, and the resultant addition represents the consumption power. In this embodiment, the power measurement device 16 includes a first and second power measurement sections 26 and 28. For example, the first power measurement section 26 is arranged in association with a U-phase line 32 and a V-phase line 34 of three-phase-alternating current lines 30 for sending driving currents to the driving motor 8. The second power measurement section 28 is arranged in association with the V-phase line 34 and a W-phase line 36 of the three-phase-alternating current lines 30. In more particular, the first power measurement section 26 includes a current detector 38, which detects a value of a current flowing through the U-phase line 32. The first power measurement section 26 measures electric power of the U-phase line 32 (i.e., the product of the detected current and voltage applied to the line) on the basis of the current value detected by the current detector 38 and the voltage value applied between the U-phase line 32 and the V-phase line 34. The second power measurement section 28 includes a current detector 40 which detects a value of a current flowing through the W-phase line 36. The second power measurement section 28 measures electric power of the W-phase line 36, on the basis of the current value detected by the current detector 40 and the voltage value of the voltage between the V-phase line 34 and the W-phase line 36. The power measurement device 16 adds those power values of the electrical power applied to the first power measurement section 26 and the second power measurement section 28. Then, the power measurement device 16 determines and measures the resultant addition as consumption power (driving power) of the current which flows through the driving motor 8 included in each vacuum pump 4, and supplies the controlling section 14 with a signal representing the measured electrical power.

Figure 4:
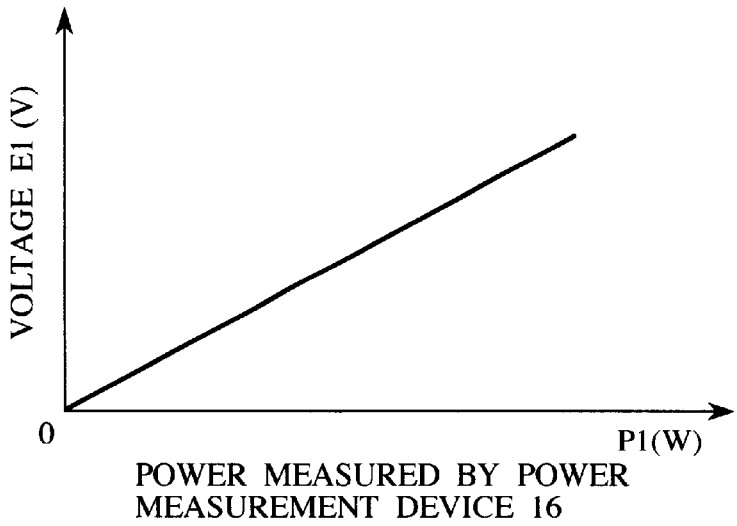
FIG. 4 is a diagram showing the relationship between the power, which is measured by the power measurement device, and a voltage value of a signal, representing the measured power, to be supplied to a controlling section.

In this embodiment, the signal representing the measured power, in which measured power P1 (W) is converted into the form of voltage E1 (V), is sent from the power measurement device 16 and is, if necessary, sent to the controlling section 14 after A/D conversion is performed. As illustrated in FIG. 4, the signal is converted into a digital signal in such a way that a signal level of the signal, i.e., a voltage level, increases in proportion to an increase in the measured power P1 (W). By doing this, after the value of the power consumed by the driving motor 8 is converted into the voltage value of the signal representing the measured power, it is sent to the controlling section 14.

The controlling section 14, as a pump controller, will now be described with reference back to FIG. 2. The controlling section 14 shown in FIG. 2 comprises an output voltage controlling section 42, an unusual event determining section 44, a hazardous event determining section 46, a first memory 48 and a second memory 50. The output voltage controlling section 42 controls, in a later-described manner, a voltage of an output signal to be sent to the inverter 12. The unusual event determining section 44 determines, in a later-described manner, any unusual event which may occur in the driving motor 8 of each vacuum pump 4, and generates a warning signal when determined that an unusual event has occurred therein. The hazardous event determining section 46 determines, in a later-described manner, any hazardous event which may occur in the driving motor 8, and generates a hazard signal when determined that a hazardous event has occurred therein. The first memory 48 stores various data regarding a warning value, a safe value and a hazard value of, for example, the driving power (consumption power). The second memory 50 stores data representing a number of times the state of the driving motor 8 is switched from a steady operational state into an unusual event checking state.

In this embodiment, while the vacuum pumps 4 are in a steady operational state, a driving current whose frequency is, for example, 60 Hz is sent to the driving motor 8 via the inverter 12. Upon reception of the driving current, the driving motor 8 is rotationally driven at 1800 rpm, for example. At this time, the consumption power (driving power) is a normal value of, for example, 1000 W. The power consumed by the vacuum pumps 4 being in this steady operational state is to increase, as the driving motor 8 has nearly worn out. Particularly, if the driving motor 8 is used for a long-term period, i.e., when the motor has nearly worn out, then a large mount of the driving power is consumed in order to attain the same rotational frequency, resulting in consuming a large amount of power. When the large amount of power is consumed, the driving motor 8 is excessively loaded. If the driving motor 8 continues to be in such a state, it will have worn out. The warning value of the driving power of the driving motor 8 is larger than the steady value, and is set to 1,500 W, for example. The hazard value of the driving power is larger than the warning value, and is set to 2,000 W, for example.

The controlling section 14 further includes a clock section 52 and a counter 54. The clock section 52 clocks a later-described first period of time, for example, in which the driving motor 8 is in operation in the unusual event checking state. The counter 54 counts a number of times the state of the driving motor 8 is switched from the steady operational state into the unusual event checking state.

A warning alarm section 56 and a hazard alarm section 58 are arranged as connected to the controlling section 14. The warning alarm section 56 comprises, for example, a yellow warning alarm lamp, etc., and is activated upon generation of a warning signal from the unusual event determining section 44. The hazard alarm section 58 comprises, for example, a red hazard alarm lamp, etc., and is activated upon generation of a hazard signal from the hazardous event determining section 46. The warning alarm section 56 (or the hazard alarm section 58) may include a warning alarm buzzer (or a hazard alarm buzzer), in addition to the warning alarm lamp (or the hazard alarm lamp) or in place of such a lamp.

The controlling section 14 supplies the inverter 12 with an activation signal. Based on this supplied activation signal, the inverter 12 varies a frequency of the driving current supplied from the power source 10, thereby to control the rotational frequency of the driving motor 8. In this embodiment, as described in FIG. 5, if a voltage E2 of the activation signal sent from the controlling section 14 increases, a frequency F of the driving current, to be sent to the driving motor 8 through the inverter 12, will proportionally increase. Then, the rotational frequency of the driving motor 8 increases.

Figure 5:
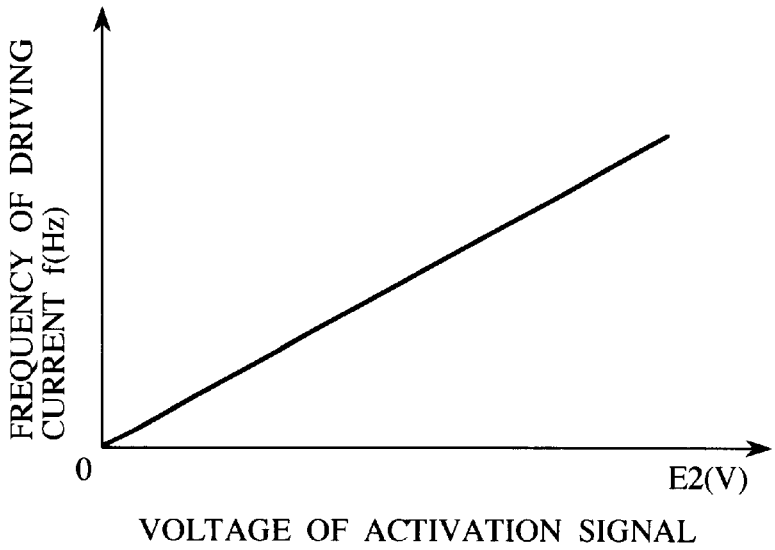
FIG. 5 is a diagram showing the relationship between a voltage value of an operational signal, to be sent from the controlling section to an inverter, and a frequency of driving current, to be sent from the inverter to a driving motor.

With reference to FIG. 2 and FIGS. 6 to 8, explanations will now be made to operations of each of the vacuum pumps 4. When each of the vacuum pumps 4 is to be activated, a driving current from the power source 10 is sent to the driving motor 8 via the inverter 12. The driving motor 8 is rotationally activated in a predetermined direction, resulting in activating the pump body 6 (Step S-1). Then, the gaseous body is sucked from the clean room 2 which will thus be exhausted of air, attaining a reduction of air pressure in the clean room 2 in a clean state. At this time, an activation signal from the controlling section 14 is maintained in a predetermined voltage level, i.e. a "steady voltage" level, by the output voltage controlling section 42, and is sent to the inverter 12. The inverter 12 sets the frequency of the driving current from the power source 10, to 60 Hz, for example, in a manner corresponding to the graph, illustrated in FIG. 5, showing the relationship between the voltage E2 of the activation signal and the frequency F of the driving current. Such a driving current whose frequency is thus varied is sent to the driving motor 8, which is then rotationally driven at a steady rotational frequency of, for example, 1,800 rpm, and each of the vacuum pumps 4 operates in a steady operational state (Step S-2).

In Step S-3, measurement is made how much the power (driving power) is consumed by the driving motor 8 included in each of the vacuum pumps 4. This measurement of the consumed power is performed by the power measurement device 16, as explained above, which sends the signal representing the measured power to the controlling section 14. Such a signal, to be set to the controlling section 14, which represents a value of measured power is converted into a voltage level, based on the graph of FIG. 4 which shows the relationship between the measured power P1 and the voltage E1. Then, the signal which has thus been converted into the voltage level is sent to the controlling section 14.

In Step S-4, determination is made whether the signal representing the measured power and being output by the power measurement device 16 enters an unusual event region, that is, whether the signal representing the measured power is equal to or exceeds a warning value S1 of (refer to FIG. 8), for example, 1,500 W (which is stored in the first memory 48). if no unusual event occurs in the driving motor 8, its rotational frequency is maintained at the steady rotational frequency of 1,800 rpm, and the power consumed by the driving motor 8 remains at a steady voltage SO of, for example, 1,000 W. However, if the driving motor 8 has nearly worn out, the power to be consumed gradually increases, even through the driving motor 8 is in a steady rotational operation.

If the power consumed by the driving motor 8 is lower than the warning value S1, for example, 1,500 W, it is determined that no unusual event is occurring in the driving motor 8, and the flow returns to Step S-2. In Step S-2, each of the vacuum pumps 4 continues to be in a steady operational state. Then, the power consumed by the driving motor 8 is repeatedly measured at regular intervals of, for example, 0.5 to 5 seconds.

While each of the vacuum pumps 4 is in the steady operational state, if the power consumed by the driving motor 8 enters a warning region, in other words, if the consumption power is equal to or exceeds the warning value S1 of, for example, 1,500 W, the flow advances to Step S-5. In Step S-5, determination is made whether the power consumed by the driving motor 8 enters a hazard region, in other words, whether the power consumed thereby is equal to or exceeds a hazard value S2 (refer to FIG. 2) of, for example, 2,000 W (which is stored in the first memory 48). When determined that the power consumed by the driving motor 8 does not reach the hazard region, the flow advances to Step S-6, in which the frequency of the driving current from the power source 10 automatically drops. In more particular, the output voltage controlling section 42 included in the controlling section 14 lowers the voltage of the activation signal, and the inverter 12 sets the frequency of the driving current, from the power source 10, to, for example, 55 Hz, thereby the rotational frequency of the driving motor 8 decreases to a rotational frequency of, for example, 1,650 rpm. As a result of the above, the state of each of the vacuum pumps 4 is switched into the unusual event checking state (Step S-7). Once the state of each of the vacuum pumps 4 is thus switched, the counter 54 included in the controlling section 14 counts a number of times the state of each vacuum pump 4 is switched into the unusual event checking state from the steady operational state. Data representing such a number of times is stored in the second memory 50. The unusual event checking state of the vacuum pumps 4 will be described later in more detail.

While each of the vacuum pumps 4 is in operation in the unusual event checking state, if the unusual event determining section 44 determines any unusual event in the driving motor 8, the flow advances from Step S-8 to Step S-9. On the other hand, when determined that no unusual event occurs in the driving motor 8, the flow returns from Step S-8 to Step S-2. At this time, the state of the vacuum pumps 4 returns from the unusual event checking state back into the steady operational state, and they continue to be operated in such a steady operational state.

When determined any unusual event in the driving motor 8, such that the driving motor 8 is nearly worn out, etc., and thus the flow advances to Step S-9, the unusual event determining section 44 generates a warning signal. Upon generation of this signal, the warning alarm section 56 is activated, thereby informing the operator of the unusual state of the vacuum pumps 4. Even in this unusual state, the vacuum pumps 4 are operated in the unusual event checking state, and their driving motors 8 are rotated at a low speed. According to this structure, the vacuum pumps 4 continue to be exhausted of air, avoiding lowering the degree of vacuum inside the clean room 2. This prevents products, i.e., the vacuum pumps, from being defective during the production process. The driving motor 8 can be rotated at a low speed, thus it is unlikely that the driving motor 8 is highly loaded, and a sudden breakdown of the driving motor 8 is avoidable. While the driving motor 8 is in an unusual state, the rotational frequency of the driving motor 8 may be set lower than that in the above-described unusual event checking state.

Even while the driving motor 8 is in operation in the unusual state, the power consumed by the vacuum pumps 4 can be measured (Step S-10). Then, determination can be made whether the power consumed thereby enters the hazard region (Step S-11). When determined that the power does not enter the hazard region, the driving motor 8 continues to be in operation in the unusual state. In this case, if the operator is aware of the unusual state of the driving motor 8 at this time, then he/she inspects and repairs the driving motor 8, and the flow returns back to Step S-1, thereafter the vacuum pumps 4 will be back in operation in the steady state.

In the case where the value of power consumed by the driving motor 8, i.e., the value of power measured by the power measurement device 16, is equal to exceeds the hazard value S2 of, for example, 2,000 W, the flow advances from Step S-5 to Step S-13, or from Step S-11 to Step S-13. In Step S-13, the hazardous event determining section 46 included in the controlling section 14 generates a hazard signal. The output voltage controlling section 42 lowers the voltage value of an activation signal sent to the inverter 12, similarly as described above, based on the generated hazard signal. Then, the frequency of the driving current sent from the power source 10 decreases to, for example, 50 Hz (Step S-14). In this embodiment, the rotational frequency of the driving motor 8 decreases to the minimum rotational frequency of, for example, 1,500 rpm, and the operational state of the vacuum pumps 4 is switched into a hazard operational state (Step S-15). The above hazard signal is sent to the hazard alarm section 58. Upon reception of this hazard signal, the hazard alarm section 58 is activated (Step S-16), thereby informing the operator of the hazard state of the driving motor 8. When the power to be consumed by the driving motor 8 reaches the hazard region, as shown with a broken line in FIG. 8, the state of the driving motor 8 is switched into the hazard operational state, and the driving motor 8 continues to be in operation in such a state. Having switched the driving motor 8 into the hazard operational state, lowering of the degree of vacuum inside the clean room 2 can be avoidable. This also prevents the driving motor 8 from being broken down as a result of an excessive load thereon. If the operator is aware of such a hazard state of the driving motor 8, and inspects and repairs the motor, the flow advances from Step S-17 to Step S-1, in which the vacuum pumps 4 are again in operation in the steady operational state.

In this embodiment, the rotational frequency of the driving motor 8 included in each vacuum pump 4 being in the hazard operational state is set lower than that in the unusual event checking state. In this structure, the driving motor 8 is further prevented from being excessively loaded. However, the rotational frequency of the driving motor 8 in each vacuum pump 4 being in the hazard operational state may be set as the same as that in the unusual event checking state.

Figure 6:
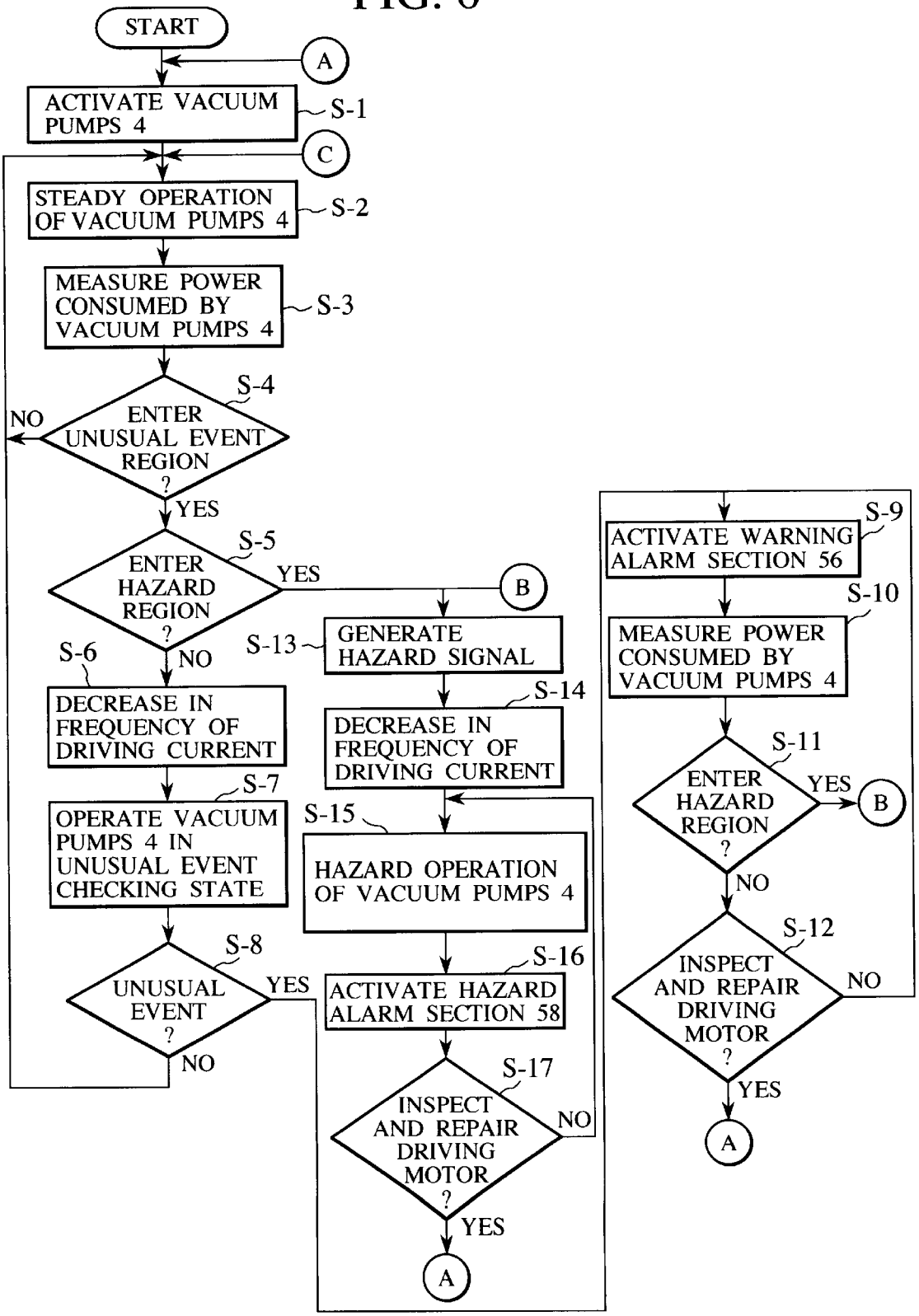
FIG. 6 is a flowchart showing the flow of an operation for monitoring any unusual event which operation is performed by the controlling apparatus of the vacuum pump illustrated in FIG. 2.
Figure 7:
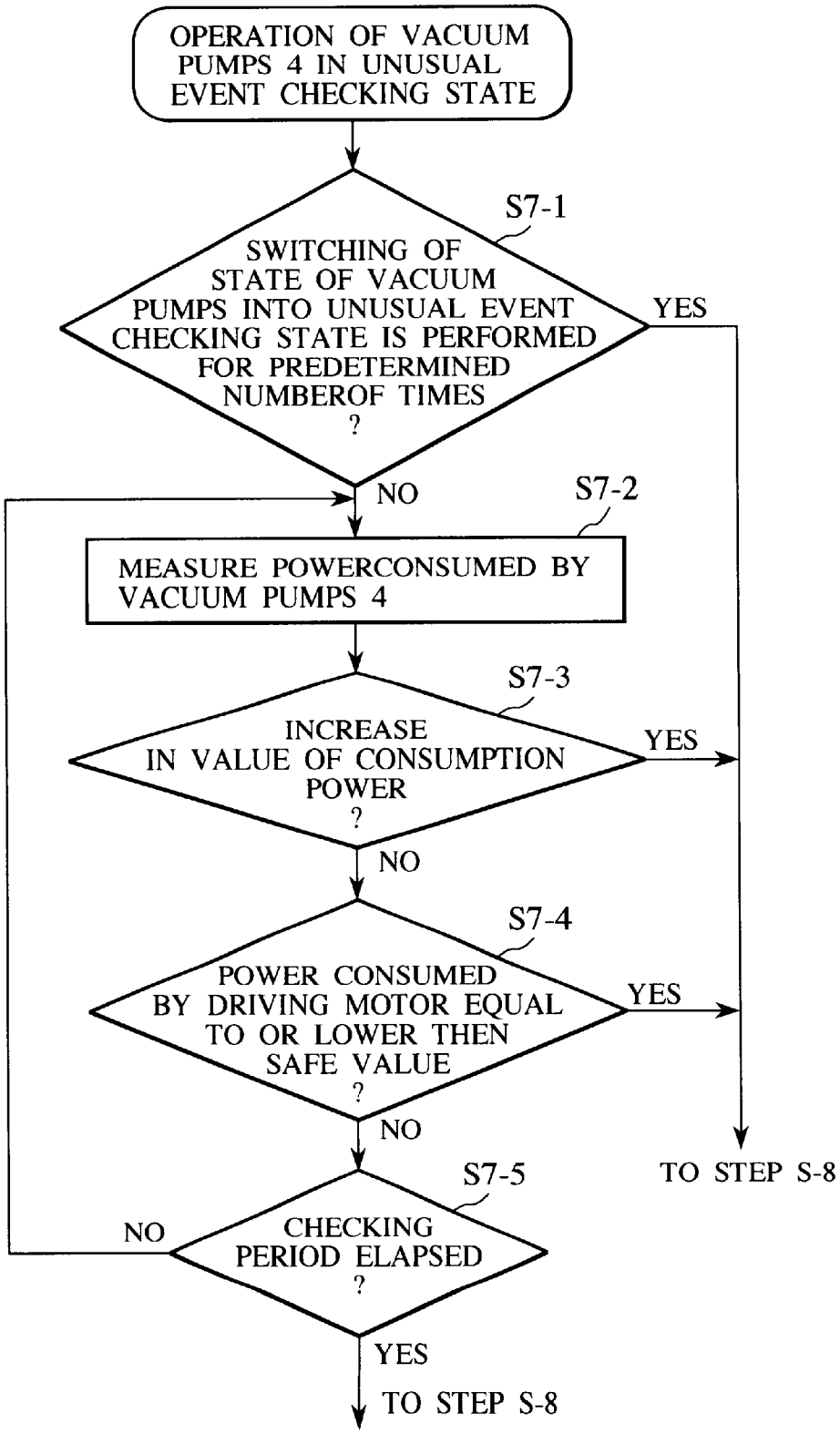
FIG. 7 is a flowchart for specifically explaining a procedure which is performed during an unusual event checking state of the vacuum pump, and which is shown in the flowchart of FIG. 6.
Figure 8:
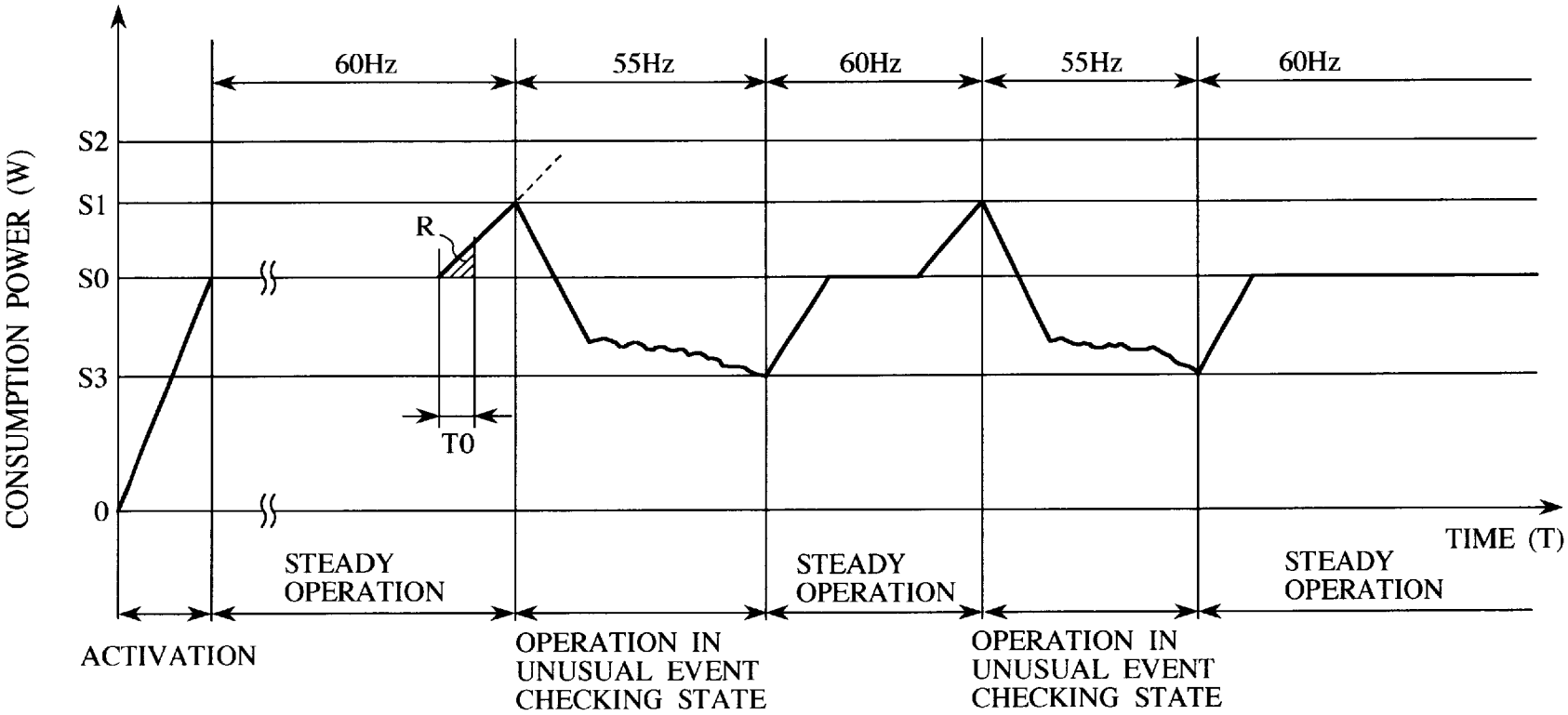
FIG. 8 is a diagram exemplarily showing the relationship between the time and the amount of power consumed by the vacuum pumps which is in operation.

With reference mainly to FIG. 7, the procedure of Step S-7, in which the vacuum pumps 4 are in operation in the unusual event checking state, will now be explained. When the state of each of the vacuum pumps 4 is switched into the unusual event checking state, the controlling section 14 determines whether the switching of the state of the vacuum pumps 4 is performed for a predetermined number of times. In this embodiment, such a predetermined number of times is set at 5, and data regarding the number is stored in the first memory 48 included in the controlling section 14. This predetermined number of times may arbitrarily be determined. At that time the switching of the state of the vacuum pumps 4 into the unusual event checking state is performed for five times, it is determined that a sufficiently large number of times the switching of the state of the vacuum pumps 4 has been performed, and the flow advances from Step S7-1 to Step S-8. In Step S-8, the unusual event determining section 44 determines that some kind of an unusual event has occurred in the driving motor 8, and the flow advances from Step S-8 to Step S9, wherein the warning alarm section 56 is activated as explained above (refer to FIG. 6).

When a number of times, the switching of the state of the vacuum pumps 4 into the unusual event checking state is performed, does not reach 5, the flow advances from Step S7-1 to Step S7-2. In Step S7-2, the power consumed by the driving motor included in each of the vacuum pumps 4 is measured. Such measurement of the power is performed by the power measurement device 16, similarly as performed in Step S-3. The power measurement device 16 sends a signal representing the measured power to the controlling section 14. Upon reception of the signal, the controlling section 14 determines whether the power consumed by the driving motor 8 included in the vacuum pumps 4 being in the unusual event checking state, i.e. the measured power, increases (Step S7-3). When the state of the vacuum pumps 4 is switched from the steady operational state into the unusual event operational state, in this embodiment, the rotational frequency of the driving motor 8 drops from 1,800 rpm to 1,650 rpm. Then, the load on the driving motor 8 becomes lighter, and the power consumed by the driving motor 8 decreases as described in FIG. 8. Even the state of the vacuum pumps 4 is switched into the unusual event checking state and the rotational frequency of the driving motor 8 decreases, the power consumed by the driving motor 8 may increase. In this case, some kind of an unusual event such that the driving motor 8 has nearly worn out is occurring therein, thus the flow advances from Step S7-2 to Step S-8. In Step S-8, the unusual event determining section 44 determines that some kind of an unusual event has occurred in the driving motor 8, and the flow advances, as explained above, from step S-8 to Step S-9 (refer to FIG. 6).

When the power consumed by the driving motor 8 does not increase, and stays substantially the same, or decreases, the flow advances to Step S7-3. In Step S7-3, the controlling section 14 determines whether the power consumed by the driving motor 8 is equal to or lower than a safe value of, for example, 800 W (Step S7-4). When the power consumed by the driving motor 8 is equal to or lower than the safe value, it is determined that the driving motor 8 is not any more excessively loaded, and the flow advances to Step S-8. At this time, it is determined that the unusual state of the driving motor 8 is over, i.e., the driving motor 8 has temporarily been in the unusual state, and the unusual event determining means 44 determines that the driving motor 8 is not any more in the unusual state, and the flow returns from Step S-8 to Step S-2. In Step S-2, the vacuum pumps 4 are back in the steady operational state, and are in operation in the above-described manner (refer to FIG. 6).

Now, the flow advances to Step S7-5, in which determination is made whether a checking period of time, during the unusual event checking state, has elapsed. A checking period of 2 to 5 hours is set as a first setting period, and data regarding the set checking period is stored in the first memory 48 included in the controlling section 14. Before the clock section 52 included in the controlling section 14 clocks the above checking period, the procedures of Step S7-2 to Step S7-5 are repeatedly performed. After the clock section 52 clocks the above checking period, the flow advances from Step S7-5 to Step S-8. In Step S-8, the unusual event determining means 44 determines that no unusual event occurs in the driving motor 8, if the power consumed by the driving motor 8 does not increase during the above checking period and the power decreases or stays the same, and the flow returns back from Step S-8 to Step S-2. In Step S-2, the vacuum pumps 4 are back into the steady operational state and are in operation in the above-described manner.

Accordingly, while the vacuum pumps 4 are in the unusual event checking state, it is determined whether the power consumed by the driving motor 8 represents an unusual state, in the above-described manner. When determined that the driving motor 8 is not in the unusual state, the state of the vacuum pump 4 is switched back into the steady operational state. Then, the vacuum pumps 4 continue to be operated in such a state until they will nearly have worn out, in other words, their driving motor 8 can be operated for a long span of time until they will nearly have worn out. When determined that the driving motor 8 is in the unusual state, the warning alarm section 56 is activated, thereby informing the operator of the driving motor 8 being in the unusual state. Thus, the operator can inspect and repair the driving motor 8 being in the unusual state, so that a predetermined degree of vacuum inside the clean room 2 can be retained.

In the above-described embodiment, the driving motor 8 included in each vacuum pump 4 being in the unusual event checking state is determined of whether it is in the unusual state by referring to the power consumed by the driving motor 8. In addition to this, such determination can be made by referring to the power consumed by, for example, each vacuum pump 4 being in the steady operational state. According to this determination, the driving motor 8 can more accurately be determined whether to be in the unusual state or not. In this case also, the power measurement device 16 sends a signal representing the measured power to the controlling section 14. Then, the controlling section 14 calculates an increasing rate of the power consumed by the driving motor 8, i.e. the area of a region R shown with a shaded portion in FIG. 8 (an increasing rate of the power consumed during a predetermined measurement period TO). When the calculated increasing rate of the power is equal to or exceeds a predetermined value, an increasing rate of a load on the driving motor 8 is extraordinarily high, thus determined that some kind of an unusual event is occurring in the driving motor 8. The unusual event determining means 44 determines that the driving motor 8 is in the unusual state, and generates a warning signal, and the flow advances to Step S-9 as shown in FIG. 6. Data regarding the predetermined measurement period TO and the increasing rate of the power are stored in the first memory 48 included in the controlling section 14.

Figure 9:
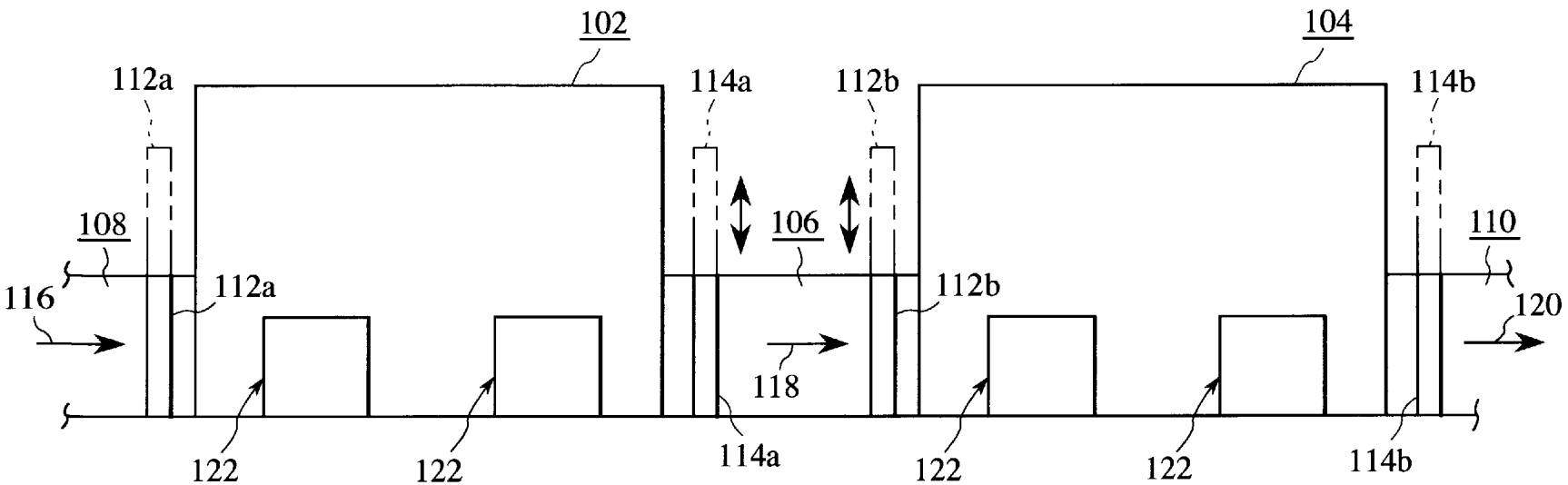
FIG. 9 is a schematic diagram schematically showing another embodiment of a clean room which adopts the second embodiment of a controlling apparatus (a controlling apparatus which carries out a process of controlling a vacuum pump according to the present invention) controlling a vacuum pump according to the present invention.
Figure 10:
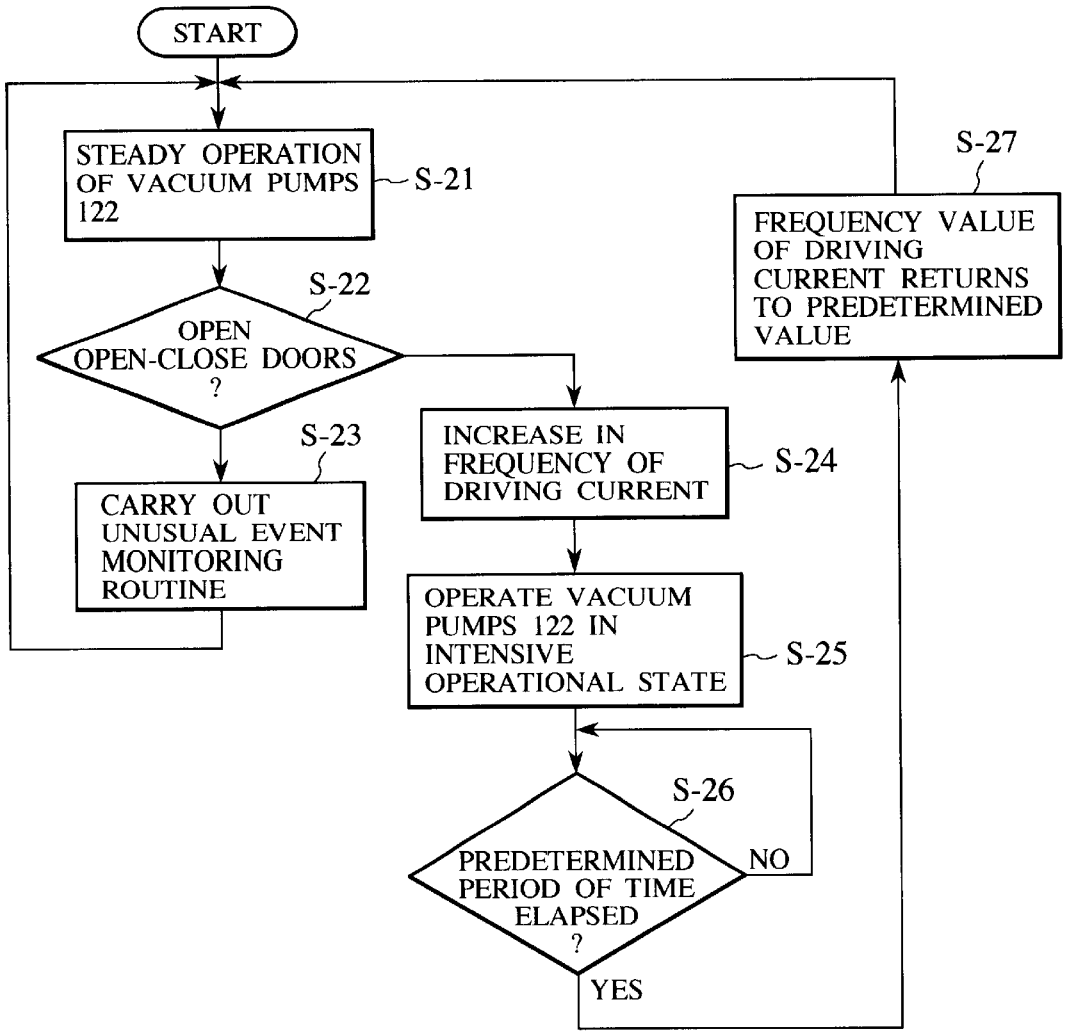
FIG. 10 is a flowchart schematically showing an operation of the vacuum pump according to the present invention.

With reference to FIGS. 9 and 10, explanations will now be made to an example of a clean room which adopts the second embodiment of a controlling apparatus controlling vacuum pumps according to the present invention.

In FIG. 9, in this embodiment, nearly-rectangular-parallelepiped rooms 102 and 104, as clean rooms each formed inside a building or the like, are prepared. Those clean rooms 102 and 104 are connected with each other via a connection room 106. The clean room 102 is connected to another clean room (not illustrated) upstream thereof via a connection room 108, while the clean room 104 is connected to another clean room (not illustrated) downstream thereof via a connection room 110.

First open-close doors 112A and 112B are arranged at the entrance side of the respective clean rooms 102 and 104 (including other clean rooms), and second open-close doors 114A and 114B are arranged at the exit side thereof, respectively. The first and second open-close doors 112A, 112B, 114A and 114B are freely and flexibly closed respectively in closing positions shown with a straight line in FIG. 9, and are freely and flexibly open in opening positions shown with a two-dot chain line in FIG. 9. In the closing positions, the connection rooms 108 and 106 and the clean rooms 102 and 104 are respectively disconnected. In the opening positions, the connection rooms 108 and 110 and the clean rooms 102 and 104 are respectively connected with each other. A semiconductor (not illustrated), for example, to be processed in the clean rooms 102 and 104 is conveyed in a direction from left to right. When the first open-close door 112A (112B) is positioned in its opening position and the entrance of the clean room 102 (104) is open, the semiconductor conveyed in accordance with an arrow 116 (118) is brought into the clean room 102 (104). After this, the first open-close door 112A (112B) is positioned in the closing position, then the entrance of the clean room 102 (104) is closed. When, for example, the second open-close door 114A (114B) is positioned in the opening position, and thus the exit of the clean room 102 (114) is open, the semiconductor which has been processed inside the clean room 102 (104) is conveyed into the connection room 106 (110) in accordance with an arrow 118 (120). After this, the second open-close door 114A (114B) is positioned in the closing position, thus the exit of the clean room 102 (104) is closed. Accordingly, the target semiconductor to be processed is conveyed through the plurality of clean rooms 102 and 104, etc.

In the system having the above structure, a plurality of vacuum pumps 122 (two in each of the clean rooms 102 and 104 shown in FIG. 9) are prepared in association with each of the clean rooms 102 and 104. Such vacuum pumps 122 may have the same structure as those vacuum pumps 4 described in the first embodiment, and thus may each comprise a pump body, sucking the gaseous body from the clean room 102 (104) and exhausting the clean room 102 (104) of air, and a driving motor, which drives the pump body. An inverter for controlling a rotational frequency of the driving motor, and a power measurement device for measuring power (driving power) to be consumed by the driving motor, both of which are connected to each vacuum pump 122, may also have the same structure of those shown in FIG. 2. Further, a controlling section which controls the operations of each vacuum pump 122 may have the same structure shown in FIG. 2 and may further include an intensive operation setting section (not illustrated) for performing intensive operations for intensively operating the vacuum pumps 122. Data regarding an intensive operation period of time, during which intensive operations are performed, may be stored in the first memory (refer to FIG. 2). An intensive operation period of, for example, 2 to 3 hours, is set as a second setting period. For easy understanding, in the second embodiment, those sections which are substantially the same as those in the first embodiment will be described with the same reference numerals.

A relatively large open-close door is not arranged at the clean room illustrated in FIG. 1, thus the degree of vacuum inside the clean room 2 is not widely varied. On the contrary, relatively large open-close doors, i.e. the first open-close doors 112A and 112B and the second open-close doors 114A and 114B, are arranged at those clean rooms 102 and 104 illustrated in FIG. 9. Hence, at that time those open-close doors 112A and 114A (112A and 114B) are open or closed, the degree of vacuum inside the clean room 102 (104) is widely varied. Therefore, it is preferable that each of the vacuum pumps 122 included in each of the clean rooms 102 and 104 shown in FIG. 9 be operated in accordance with the flowchart shown in FIG. 10.

With reference mainly to FIG. 10, normally, a driving current whose frequency is 60 Hz is sent to each vacuum pump 122 arranged in the clean room 102 (104). Then, the driving motor 8 (not illustrated) is rotationally driven at a frequency of, for example, 1,800 rpm, and each vacuum pump 122 will be in operation in a steady operational state (Step S-21). At this time, the first open-close door 112A (112B) in the entrance side of the clean room 102 (104) retains to be in a closing state, and the second open-close door 114A (114B) in the exit side thereof retains to be in the closing state, as well, then the flow advances from Step S-22 to Step S-23. In Step S-23, an unusual event monitoring routine for monitoring any unusual event occurring in each of the vacuum pumps 122 is carried out. Following this unusual event monitoring routine, the vacuum pumps 122 are operated in accordance with the flowcharts shown in FIGS. 6 and 7, and they are maintained to be in operation in the above-described steady operational state until power consumed by the driving motor 8 included in each vacuum pump 122 is equal to or exceeds a warning value of, for example, 1,500 W. When the power consumed thereby is equal to or exceeds the warning value, each of the vacuum pumps 122 is in operation in the unusual event checking state. When the power is equal to or exceeds a hazard value of, for example, 2,000 W, each of the vacuum pumps 122 is in operation in the hazard operational state.

While the vacuum pumps 122 are operated in the steady operational state, if the first open-close door 122A (122B) and/or the second open-close door 144A (144B) is (are) open, the flow advances from Step S-22 to Step S24. In Step S-24, the intensive operation setting section (not illustrated) generates an intensive operational signal. Based on this intensive operational signal, the output voltage controlling section 42 controls a voltage value of an activation signal, which is to be sent to the inverter 12, to increase. By doing this, a frequency of a driving current which is sent to the driving motor 8 from the power source 10 via the inverter 12 increases to, for example, 65 Hz (Step S-24). In this circumstance, the rotational frequency of the driving motor 8 increases, thereby the driving motor 8 is rotationally driven at, for example, 1,950 rpm, and the vacuum pumps 122 are in operational in the intensive operational state (Step S-25). In this intensive operational state, the suction of gaseous body inside each vacuum pump 122 and the exhaustion of each vacuum pump 122 are effectively performed. Thus, a decrease in the degree of vacuum inside the clean room 102 (104), resulting from the opening of the first open-close door 112A (112B) and/or the second open-close door 114A (114B), can recover in a relatively short period of time. Hence, the production of any defective semiconductors, etc., for example, can be avoidable.

The vacuum pumps 122 continue to be in operation in the intensive operational state until the clock section 52 included in the controlling section 14 clocks the second setting period, and after a predetermined period of time, the flow advances from Step S-26 to Step S-27. In Step S-27, generation of an intensive operation signal, as performed by the intensive operation setting section, is completed. After this, the output voltage controlling section 42 controls back the voltage value of the activation signal, which is to be sent to the inverter 12, and each vacuum pump 122 is in operation back in the steady operational state.

Accordingly, if the open-close doors 112A and 114A (112B and 114B) are open, each of the vacuum pumps 122 is in the intensive operational state. Thus, even if the power consumed by the driving motor 8 increases, the state of the vacuum pumps 122 is not switched into the unusual event checking state, and the vacuum pumps 122 are maintained to be in the intensive operational state during the second setting period. This prevents the occurrence of a dramatic decrease in the degree of vacuum inside the clean room 102 (104), and also prevents any defective semiconductors, etc., from being produced inside the clean room (104).

As can be understood from the above description, according to the controlling apparatus for and the method of controlling the above vacuum pumps, the unusual state of the driving motor included in each vacuum pump is monitored with reference to the driving power to be sent thereto, and when the driving power reaches or exceeds the warning value, the operational state of each vacuum pump is switched from the steady operational state into the unusual event checking state. If the driving motor included in the vacuum pump has nearly worn out, a large amount of the driving power is consumed thereby. Hence, if the driving motor is rotationally driven at a constant rotational frequency, the driving power consumed thereby increases. According to the above structure, if the driving power is equal to or exceeds a warning value, the state of the vacuum pump is switched into the unusual event checking state. During this unusual event checking state, determination of whether the driving motor has nearly worn out can easily be performed while being in operation. The vacuum pump is kept being operated in the unusual event checking state, thus the degree of vacuum inside the clean room as a room retaining the vacuum is unlikely to decrease. Besides, a predetermined degree of vacuum thereinside can be retained while determining whether each vacuum pump is in the unusual event checking state. This prevents those products to be produced in, for example, the clean room from being defective.

According to the controlling apparatus for and method of controlling the vacuum pump, during the unusual event checking state of the vacuum pump, the power for driving the driving motor may decrease to a safe value. In this case, an increase in the driving current temporarily occurs as a result of an excessive load on the driving motor, and it can be determined that the driving motor has not yet worn out. Thus, the operational state of the driving motor can be switched from the unusual event checking state into the steady operational state. In such circumstances, the driving motor can continuously be driven in the steady operational state for a long term of period, while monitoring whether it has nearly worn out.

According to the controlling apparatus for and the method of controlling the vacuum pump, during the unusual event checking state of the vacuum pump, the power consumed by the driving motor may substantially decrease or may stay constant for the first setting period. In this case, the increase in the driving current temporarily occurs as a result of an excessive load on the driving motor, and it can be determined that the driving motor has not yet worn out. Thus, the operational state of the driving motor can be switched from the unusual event checking state into the steady operational state. In such circumstances the driving motor can continuously be operated for a long term of period, while monitoring whether it has nearly worn out.

According to the controlling apparatus for and method of controlling the vacuum pump, when the steady operational state and the unusual event checking state of the vacuum pump are repeatedly switched for a predetermined number of times, it is determined that the driving motor is in an unusual state. The switching of the steady operational state and the unusual event checking state is performed, because the driving power for driving the driving motor included in the vacuum pump tends to increase, and the driving motor has nearly worn out.

According to the controlling apparatus for and method of controlling the vacuum pump, if the driving power to be consumed by the driving motor increases, it is determined that the driving motor is in the unusual state. While the vacuum pump is in operation in the unusual event checking state, if the driving motor is determined to be in the steady operational state, the driving power is to decrease. In such circumstances where the vacuum pump is in the unusual event checking state, the driving power increases, because it is likely that the driving motor has nearly worn out.

According to the controlling apparatus for and method of controlling the vacuum pump, even while the vacuum pumps are in the steady operational state, monitoring of whether some kind of unusual event, such that the driving motor has nearly worn out, is occurring can be performed. Furthermore, while the vacuum pumps are in the steady operational state, with a dramatic increase in the load on the driving motor, the driving power dramatically increases as well. If an increasing rate of the driving power is equal to or exceeds a predetermined value, it is determined that the driving motor is in the unusual state. By performing such determination, monitoring of the unusual state of the driving motor can be achieved with high accuracy.

According to the controlling apparatus for and method of controlling the vacuum pump, the rotational frequency of the driving motor included in each vacuum pump is set lower in the unusual event checking state than in the steady operational state. Having set the lower rotational frequency of the driving motor in the unusual event checking state, a small amount of driving power consumed by the driving motor is necessary. This prevents a breakdown of the driving motor as a result of an excessive load thereon. Moreover, the rotational movement of the driving motor, in other words, the activation of the vacuum pumps, can be retained, and a decrease in the degree of vacuum inside a room, for example, the clean room, can be avoidable.

According to the controlling apparatus for and method of controlling the vacuum pump, if the power for driving the driving motor is equal to or exceeds a hazard value, the hazardous event determining section determines that the driving motor is in the hazard state. If such a driving motor has nearly worn out, the power consumed thereby increases. Thus, if the driving motor is rotationally driven at a constant rotational frequency, the driving power tends to dramatically increase. Accordingly, if the driving power is equal to or exceeds the hazard value, it is determined that the driving motor is in the hazard state. At the same time, the operational state of the vacuum pumps is switched into the hazard operational state, thereby a breakdown of the driving motor, resulting from an excessive load thereon, can be avoided, and the degree of vacuum inside a room, for example, the clean room, is maintained.

In addition to the above, according to the controlling apparatus for and method of controlling the vacuum pump, the open-close door which serve as the boundary between the rooms are open or closed, the vacuum pump is maintained in the intensive operational state during the second setting period. Further, the decrease in the degree of vacuum inside the clean room can recover within a relatively short period of time. During the second setting period, the degree of vacuum inside the room decreases. Therefore, it is not preferable that the rotational frequency of the driving motor included in each vacuum pump decrease. Even if the power for driving the driving motor increases, the operational state of the vacuum pump is not switched into the unusual event checking state.

Explanations have so far been made to the controlling apparatus (method) for controlling the vacuum pumps according to the present invention. Various embodiments and changes may be made thereonto without departing from the broad spirit and scope of the invention. The above-described embodiments are intended to illustrate the present invention, not to limit the scope of the present invention.

What is claimed is:

1. A controlling apparatus, for controlling at least one vacuum pump, comprising: at least one vacuum pump which includes a pump body for sucking a gaseous body from a room and exhausting the room of the gaseous body and a driving motor for driving the pump body; and controlling means for controlling the driving motor included in each of said at least one vacuum pump, and said apparatus including a power measurement device which measures driving power to be sent to the driving motor, and wherein said controlling means switches a state of said at least one vacuum pump from a steady operational state into an unusual event checking state, in which any unusual event in said at least one vacuum pump is detected, when a value of the power measured by said power measurement device is equal to or exceeds a warning value which is higher than a fixed value, and wherein said controlling means controls the state of said at least one vacuum pump from the unusual event checking state into the steady operational state, when the power of the driving power decreases to a safe value, which is lower than the fixed value, during a first setting period which said vacuum pump is in operation in the unusual event checking state.

2. The controlling apparatus for controlling at least one vacuum pump, according to 1, wherein said controlling means which includes unusual event determining means for determining whether the driving motor included in said at least one vacuum pump is in an unusual state, and said unusual event determining means determines that the driving motor is in the unusual state, when the steady operational state and the unusual event checking state of said at least one vacuum pump is repeatedly switched from one to another for a predetermined number of times.

3. The controlling apparatus, for controlling at least one vacuum pump, according to claim 1, wherein said controlling means controls the state of said at least one vacuum pump from the unusual event checking state back into the steady operational state, when the power measured by said power measurement device substantially drops or substantially stays constant throughout a first setting period while said at least one vacuum pump is in operation in the unusual event checking state.

4. The controlling apparatus, for controlling at least one vacuum pump, according to claim 3, wherein said controlling means includes unusual event determining means for determining whether the driving motor included in said at least one vacuum pump is in an unusual state, and said unusual event determining means determines that the driving motor is in the unusual state, when the steady operational state and the unusual event checking state of said at least one vacuum pump is switched from one to another for a predetermined number of times.

5. The controlling apparatus, for controlling at least one vacuum pump, according to claim 4, wherein said unusual event determining means calculates an increasing rate of the power measured by said power measurement device while said at least one vacuum pump is in the steady operational state, and determines, when the calculated increasing rate of the measured power is equal to or exceeds a predetermined value, that the driving motor is in an unusual state.

6. The controlling apparatus, for controlling at least one vacuum pump, according to claim 1, wherein said controlling means includes unusual event determining means for determining whether the driving motor included in said at least one vacuum pump is in an unusual state, and said unusual event determining means determines, when the power measured by said power measurement device substantially increases while said at least one vacuum pump is in operation in the unusual event checking state, that the driving motor is in the unusual state.

7. The controlling apparatus, for controlling at least one vacuum pump, according to claim 1, said apparatus including an inverter for controlling a rotational frequency of the driving motor included in said at least one vacuum pump, and wherein said controlling means controls the inverter which converts a frequency of a driving current to be sent to the driving motor, so that, when the state of said at least one vacuum pump is switched from the steady operational state into the unusual event checking state, the frequency of the driving current to be sent to the driving motor decreases, thereby the rotational frequency of the driving motor drops.

8. The controlling apparatus, for controlling at least one vacuum pump, according to claim 1, wherein:

said controlling section includes hazardous event determining means for determining whether the driving motor is in a hazard state;

said hazardous event determining means determines that the driving motor is in the hazard state, when the value of the power measured by the power measurement device is equal to or exceeds a hazard value which is higher than the warning value; and said controlling means switches the state of said at least one vacuum pump into a hazard operational state.

9. A controlling apparatus, for controlling at least one vacuum pump, comprising: at least one vacuum pump which includes a pump body for sucking a gaseous body from a room and exhausting the room of the gaseous body and a driving motor for driving the pump body; and controlling means for controlling the driving motor included in each of said at least one vacuum pump, and said apparatus including a power measurement device which measures driving power to be sent to the driving motor, and wherein said controlling means switches a state of said at least one vacuum pump from a steady operational state into an unusual event checking state, in which any unusual event in said at least one vacuum pump is detected, when a value of the power measured by said power measurement device is equal to or exceeds a warning value which is higher than a fixed value, and wherein at least one open-close door is arranged along the room;

said controlling means switches the state of said at least one vacuum pump from the steady operational state into an intensive operational state, in which suction of the gaseous body from the room is effectively performed, when said open-close door is open or closed; and said at least one vacuum pump is maintained to be in operation in the intensive operational state throughout a second setting period.

10. A method of controlling at least one vacuum pump, which comprises a pump body for sucking a gaseous body from a room and exhausting the room of the gaseous body and a driving motor for driving the pump body, said method comprising:

switching a state of said at least one vacuum pump from a steady operational state into an unusual event checking state, in which any unusual event in said at least one vacuum pump is detected, when a value of driving power to be sent to the driving motor is equal to or exceeds a warning value, which is higher than a fixed value; and controlling the state of said at least one vacuum pump from the unusual event checking state into the steady operational state, when the power of the driving power decreases to a safe value, which is lower than the fixed value, during a first setting period which said vacuum pump is in operation in the unusual event checking state.

11. The method of controlling at least one vacuum pump, according to claim 10, said method comprising controlling the state of said at least one vacuum pump from the unusual event checking state into the steady operational state, when the driving power substantially drops or substantially stays constant through the first setting period, while said at least one vacuum pump is in operation in the unusual event checking state.

12. The method, of controlling at least one vacuum pump, according to claim 10, said method comprising unusual event determining means for determining whether said at least one vacuum pump is in an unusual state, and wherein said unusual event determining means determines that the driving motor is in an unusual state, when the steady operational state and the unusual event checking state of said at least one vacuum pump is repeatedly switched from one to another for a predetermined number of times.

13. The method, of controlling at least one vacuum pump, according to claim 11, said method comprising unusual event determining means for determining whether said at least one vacuum pump is in an unusual state, and wherein said unusual event determining means determines that the driving motor is in an unusual state, when the steady operational state and the unusual event checking state of said at least one vacuum pump is repeatedly switched from one to another for a predetermined number of times.

14. The method, of controlling at least one vacuum pump, according to claim 10, said method comprising unusual event determining means for detecting any unusual event in said at least one vacuum pump, and wherein said unusual event determining means determines that the driving motor is in an unusual state, when the value of the driving power substantially increases, during the unusual event checking state of said at least one vacuum pump.

15. The method, of controlling at least one vacuum pump, according to claim 14, wherein said unusual event determining means determines that the driving motor is in an unusual state, when an increasing rate of the driving power is equal to or exceeds a predetermined value, during the steady operational state of said at least one vacuum pump.

16. The method, of controlling at least one vacuum pump, according to claim 10, wherein a rotational frequency of the driving motor is lower, during the unusual event checking state of said at least one vacuum pump, than a rotational frequency of the driving motor, during the steady operational state of said at least one vacuum pump.

17. The method, of controlling at least one vacuum pump, according to claim 10, said method including hazardous event determining means for determining that said at least one vacuum pump is in a hazard state, and wherein hazardous event determining means determines that said at least one vacuum pump is in a hazard state, when the value of the driving power is equal to or exceeds a hazard value, which is higher than the warning value, and switches the state of said at least one vacuum pump into a hazard operational state.

18. A method, of controlling at least one vacuum pump, which comprises a pump body for sucking a gaseous body from a room and exhausting the room of the gaseous body and a driving motor for driving the pump body, wherein at least one open-close door is arranged along the room, said method comprising:

switching a state of said at least one vacuum pump from a steady operational state into an unusual event checking state, in which any unusual event in said at least one vacuum pump is detected, when a value of driving power to be sent to the driving motor is equal to or exceeds a warning value, which is higher than a fixed value;

switching the state of said at least one vacuum pump from the steady operational state into an intensive operational state, in which suction of the gaseous body from the room is effectively performed, when the at least one open-close door is open or closed; and maintaining the intensive operational state for a second setting period.

* * * * *